US006336491B1

(12) United States Patent
Sakamoto

(10) Patent No.: US 6,336,491 B1
(45) Date of Patent: Jan. 8, 2002

(54) ADHESIVE-TAPE DISPENSER

(76) Inventor: Yasuaki Sakamoto, 23-43 Harinokimata, Amarube-cho, Kameoka-shi, Kyoto 621-0806 (JP)

( * ) Notice: Subject to any disclaimer, the term of this patent is extended or adjusted under 35 U.S.C. 154(b) by 0 days.

(21) Appl. No.: 09/477,716

(22) Filed: Jan. 5, 2000

(30) Foreign Application Priority Data

Dec. 27, 1999 (JP) ..... 11-371594
Dec. 28, 1999 (JP) ..... 11-009963

(51) Int. Cl.[7] ..... B32B 31/00

(52) U.S. Cl. ..... 156/523; 156/540; 156/574; 156/577

(58) Field of Search ..... 156/523, 527, 156/538, 539, 540, 574, 577, 579, DIG. 48; 242/588.6

(56) References Cited

U.S. PATENT DOCUMENTS 5,759,341 A * 6/1998 Kobayashi ..... 156/540
5,770,007 A * 6/1998 Czech et al. ..... 156/540
6,029,729 A * 2/2000 Sieber et al. ..... 156/577
6,053,233 A * 4/2000 Lin ..... 156/523

* cited by examiner

*Primary Examiner*—James Sells
(74) *Attorney, Agent, or Firm*—Crowell & Moring LLP

(57) ABSTRACT

An adhesive-tape dispenser of this invention comprises a tape roll holder, a dispenser housing for accommodating the tape roll holder, and a tape-leading and cutting means. The tape-leading and cutting means enables to separate the suitable length of a tape from a tape roll and to easily adhere the separated tape to an objective material, before (almost at the same time) or after the tape is cut off. Furthermore, a tape separator mounted on the tape roll holder enables multi-use for various adhesive tapes such as a non-protected single-side adhesive tape in roll, and a double-side adhesive tape in roll, of which one or both adhesive surfaces are protected by a peeling tape.

8 Claims, 5 Drawing Sheets

ADHESIVE-TAPE DISPENSER

BACKGROUND

This invention relates to a tape dispenser, and more particularly to an adhesive-tape dispenser designed to cut the tape for facilitating a fast and effective operation of the dispenser with one hand.

In relation to a cutting device of a rolled adhesive tape, particularly to a hand-held or desk-top type, there had been proposed various tape-cutters and tape-dispensers. This applicant has also proposed a tape-cutter with a simple structure and easy usage owing to a safety guide.

The tape cutter comprises a tape roll holder having a one-side-wall with plural protrusions for holding a central portion of the tape roll, a tape guide member integrally formed with the tape roll holder, and a cutter housing for setting the tape roll holder.

The cutter housing is equipped with a slide guide for inserting and taking out the tape roll holder, a tape outlet formed in the dispenser housing, and a cutting means which is pivoted in the tape outlet of the dispenser housing and biased on the opposite side to the tape-leading direction by a bias means.

The tape-leading and cutting means includes a tape-lead roller co-operated with the tape guide member. Further, it includes a cutting blade designed to be projected from an opening-portion when the tape is pulled out against the bias of the bias means to the tape-leading direction from the tape roll through the tape guide member and the tape-lead roller.

Accordingly, this tape cutter has such a merit that it is safe because the cutting blade is exposed to the outside of the cutter housing only when in use.

SUMMARY OF THE INVENTION

An object of this invention is to provide an improved adhesive-tape dispenser which enables multi-use for various adhesive tapes such as a non-protected single-side adhesive roll tape, and a double-side adhesive roll tape, of which one or both adhesive surfaces are protected by a peeling tape.

Another object of this invention is to provide an improved adhesive-tape dispenser which enables both uses for two cutting systems designed to separate the suitable length of the tape from the tape roll, before or after the pulled out tape is adhered to the objective material.

Therefore, the tape dispenser of this invention comprises a tape roll tape roll holder with a one-side-wall having arc-shaped protrusions for holding the central portion of the tape roll, a tape guide member integrally formed with the tape roll holder, and a dispenser housing for setting the tape roll holder. The dispenser housing also comprises a slide guide for inserting and taking out the tape roll holder, a stopper for fixing the tape roll holder in an insertion condition, a tape outlet formed in the dispenser housing, and a tape-leading and cutting means.

The tape-leading and cutting means in this invention particularly includes a rotative-action member and a direct-action member. The rotative-action member is pivoted in the tape outlet of the dispenser housing and biased on the opposite side to the tape-leading direction by the bias means. The rotative-action member includes a tape-lead roller co-operated with the tape guide member, and a cutting blade. The cutting blade is designed to be projected from the opening-portion when the tape is pulled out from the tape roll through the tape guide member and pushed to the tape-lead roller against the bias of the bias means.

The direct-action member is pivoted near the tape outlet of the dispenser housing 2, and includes a friction roller positioned away from the tape outlet via a tape guide surface formed on the dispenser housing. Furthermore, the direct-action member includes a cutting blade which is designed to be projected from the opening-portion between the tape outlet and the tape guide surface when the friction roller is pushed to a surface of a objective material against the bias of the bias means.

The tape dispenser of this invention may include a separator designed to separate a peeling tape from an adhesive tape before it is pulled out.

DESCRIPTION OF PREFERRED EMBODIMENTS

Figure 1:
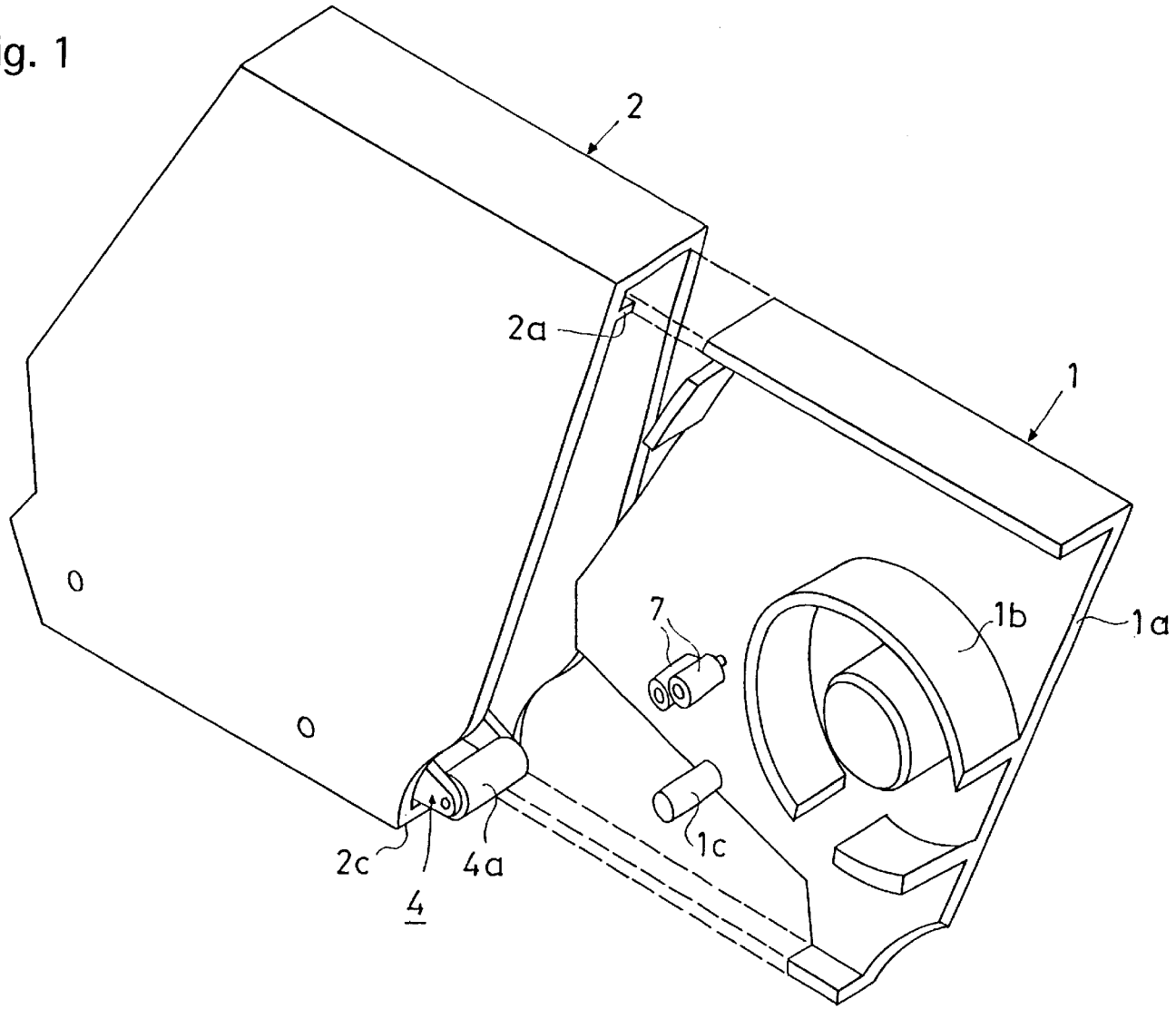
FIG. 1 is a perspective view of an adhesive-tape dispenser as illustrated in the first embodiment of this invention.
Figure 2:
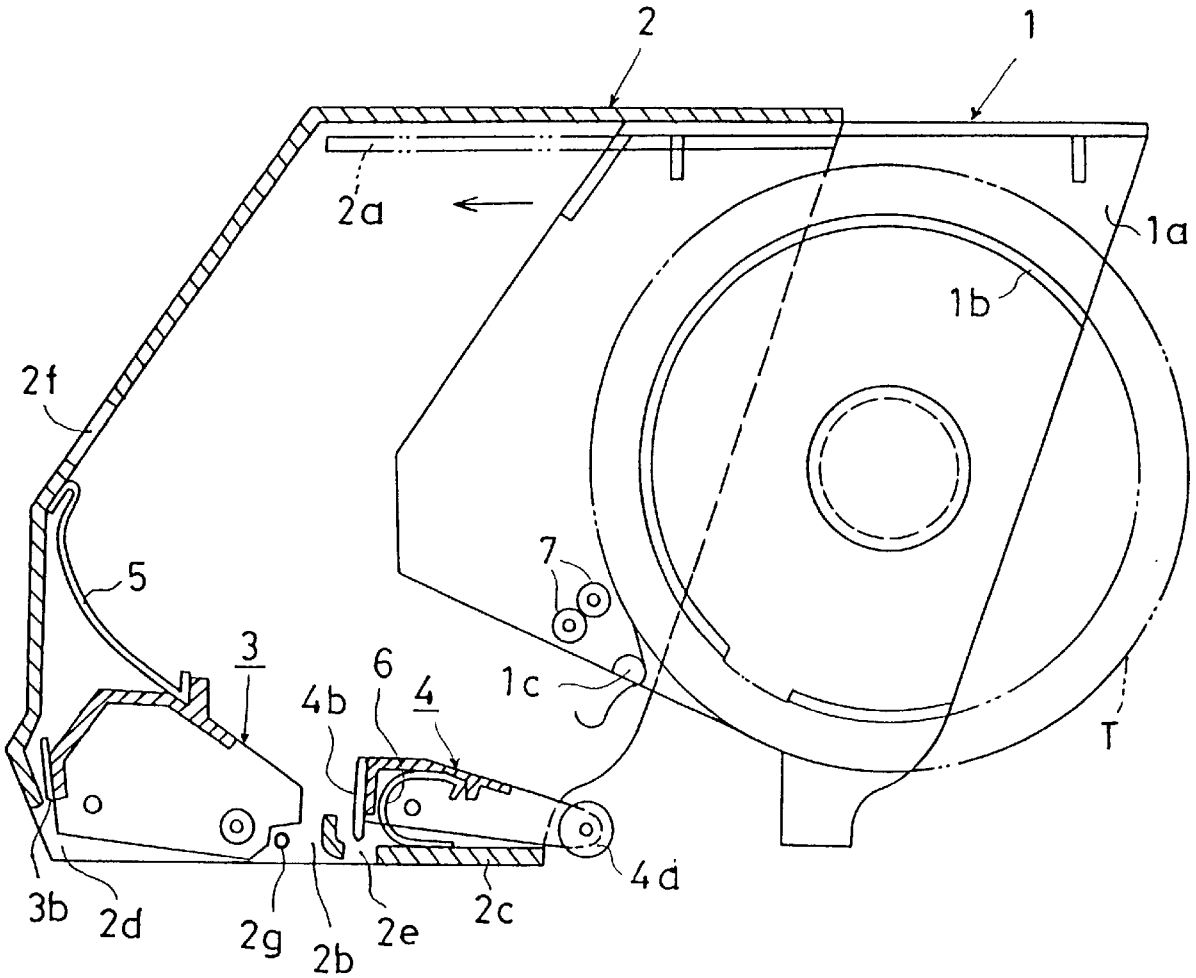
FIG. 2 is a cross-sectional side view of an adhesive-tape dispenser.
Figure 3:
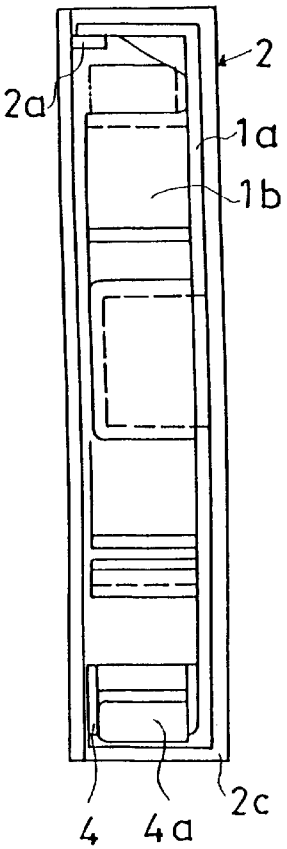
FIG. 3 is a front view of an adhesive-tape dispenser.
Figure 4:
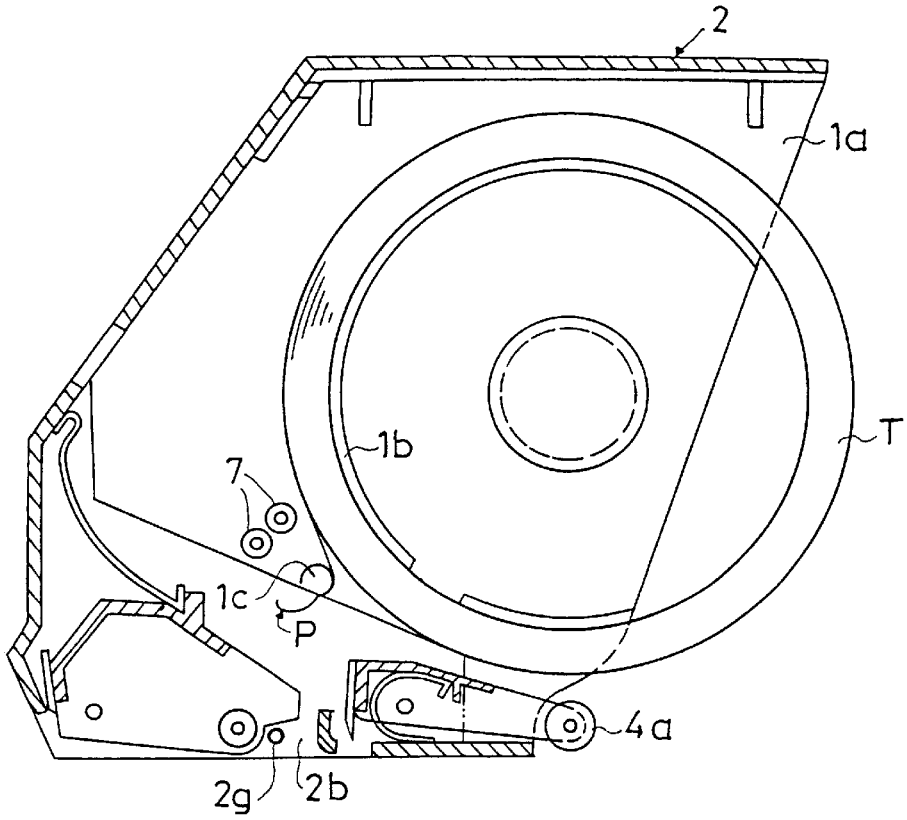
FIG. 4 is a cross sectional side view of a dispenser housing of the adhesive-tape dispenser in which a tape roll holder is inserted.
Figure 5:
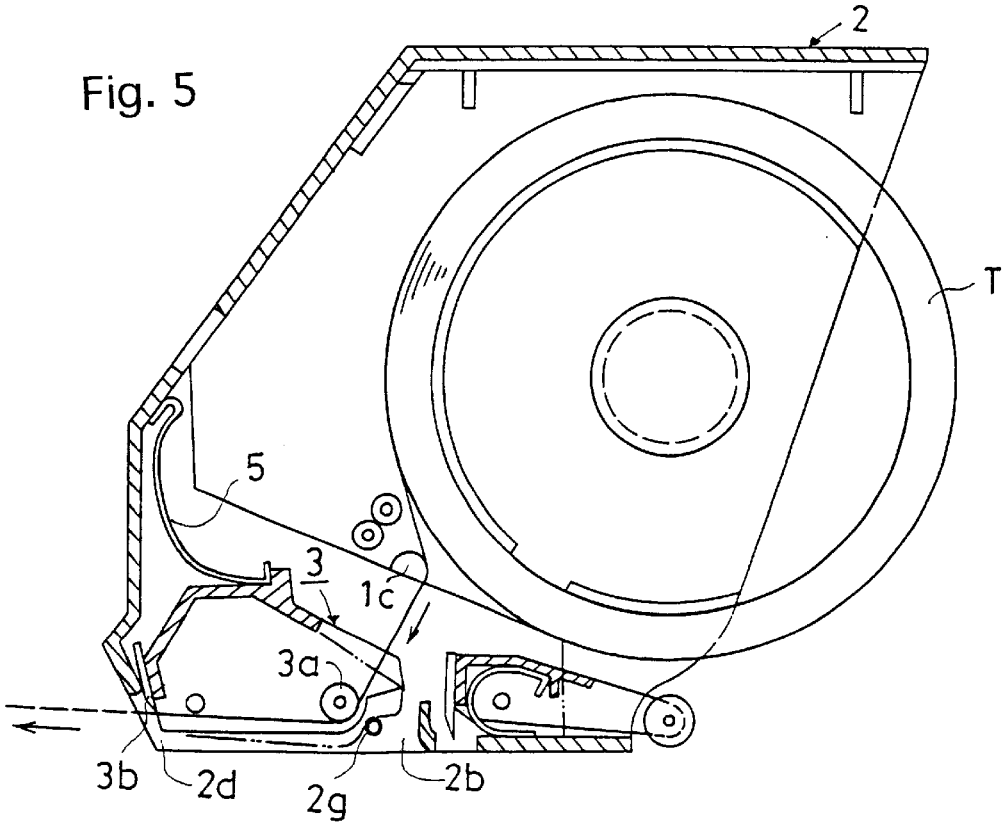
FIG. 5 is a cross-sectional side view of an adhesive-tape dispenser used for a single-side adhesive tape in one operating condition.

This invention is described in details with reference to preferred embodiments illustrated in the accompanying drawings.

(First Embodiment)

With reference to FIGS. 1 to 5, an adhesive-tape dispenser in this invention will be described as follows. The dispenser comprises a tape roll holder 1 having a one-side-wall 1*a* with arc-shaped protrusions 1*b* for holding the central portion of the tape roll T.

A tape guide member 1*c* is integrally formed with the tape roll holder 1 (the tape guide member may be made as a roller or rollers), and the dispenser includes a dispenser housing 2 for setting the tape roll holder 1.

The dispenser housing 2 is formed into a box shape with a narrow thickness. The dispenser housing mainly comprises two action members, one end portion, one holder side large-opening-portion for inserting the tape roll holder 1, and plural opening-portions. More particularly, the dispenser housing 2 is equipped with a slide guide 2*a* for the tape roll holder 1, a tape outlet 2*b* formed in the dispenser housing 2, rotative-action member side opening-portion 2*d*, direct-action member side opening-portion 2*e*, and a side-end opening-portion 2*f*, and a means for leading and cutting the tape.

The tape-leading and cutting means in this invention particularly comprises a rotative-action member 3 and a direct-action member 4. The rotative-action member 3 is pivoted in the tape outlet 2*b* of the dispenser housing 2 and biased on the opposite side to the tape-leading direction by a bias means 5. In this embodiment, the bias means 5 is made of a flexible steel belt.

The rotative-action member 3 comprises a tape-lead roller 3*a* co-operated with the tape guide member 1*c*, and a cutting blade 3*b*. The cutting blade 3*b* is designed to be projected from the rotative-action member side opening-portion 2*d* when the tape is pulled out towards the holder side end direction of the rotative-action member side at its tip and is pressed against the bias of the bias means 5 to the tape-leading direction after the tape of a required length is pulled out from the tape roll through the tape guide member 1*c* and the guide roller 3*a*.

The direct-action member 4 is pivoted near the tape outlet 2*b* of the dispenser housing 2, and includes a friction roller 4*a* positioned away from the tape outlet 2*b* via a tape guide surface 2*c* formed on the dispenser housing 2. Furthermore, the direct-action member 4 includes a cutting blade 4*b* arranged to the tape guide surface 2*c* near the one edge of the tape. The cutting blade 4*b* is moved to the outside of the dispenser housing in advance when the friction roller 4*a* is pushed down into the dispenser housing, and retreated in a manner to be biased by a bias means 6, which is disposed at the in the dispenser housing.

In this embodiment, the dispenser housing 2 includes a stopper 2*g* integrally formed with its side portion so as to limit the rotating motions of the rotative-action member 3 when the cutting blade 3*b* is advanced or retreated to the rotative-action member side opening-portion 2*d*.

In this embodiment, the tape dispenser may include a separating means 7 such as a pair of rollers mounted on the tape roll holder 1. The separating means 7 is designed to separate a peeling tape P from an adhesive tape before it is pulled out.

In operation, the tape roll T having a non-protected one-side adhesive surface is set in the tape roll holder 1 together with its central portion fitting to the arc-shaped protrusions 1*b*, and the tape end portion pulled out is temporarily contacted to the tape guide member 1*c*.

Then, the tape roll holder 1 is inserted into the dispenser housing 2, in a manner to be guided to the slide guide 2*a*, and the tape end is introduced to the tape-lead roller 3*a* in the tape outlet 2*b*.

A user picks up the tape end portion, and the tape is pulled out and then cut by the cutting blade 3*b* after the suitable length is fed. In this case, the cutting blade 3*b* is advanced to the rotative-action member side opening-portion 2*d* according to the rotating motion of the rotative-action member 3 around its pivots, because the guide roller 3*a* is pushed by the pulled tape portion against the bias of the bias means 5.

Accordingly, this tape dispenser has such a merit that it is safe because the cutting blade is exposed to the outside of the dispenser housing only when in use.

When the user, while gripping the adhesive-tape dispenser, adheres the pulled tape directly to the surface of the object before the tape is cut, the tape is guided through the tape outlet 2*b* without aid of the guide roller 3*a*. Then, the tape end is introduced from the edge of the tape outlet 2*b* to a tape guide surface 2*c* in a manner to be pulled along the tape guide surface 2*c*.

At the point where the tape is to be cut, the user can push the friction roller 4*a* to the surface of the object through on the opposite side to the adhesive surface of the tape. Accordingly, the direct-action member 4 is turned against the bias of the bias means 6 so as to advance the cutting blade 4*b*, thereby to cut the pulled tape at a position near the direct-action member side opening-portion 2*e* (between the tape outlet 2*b* and the tape guide surface 2*c*).

Figure 6:
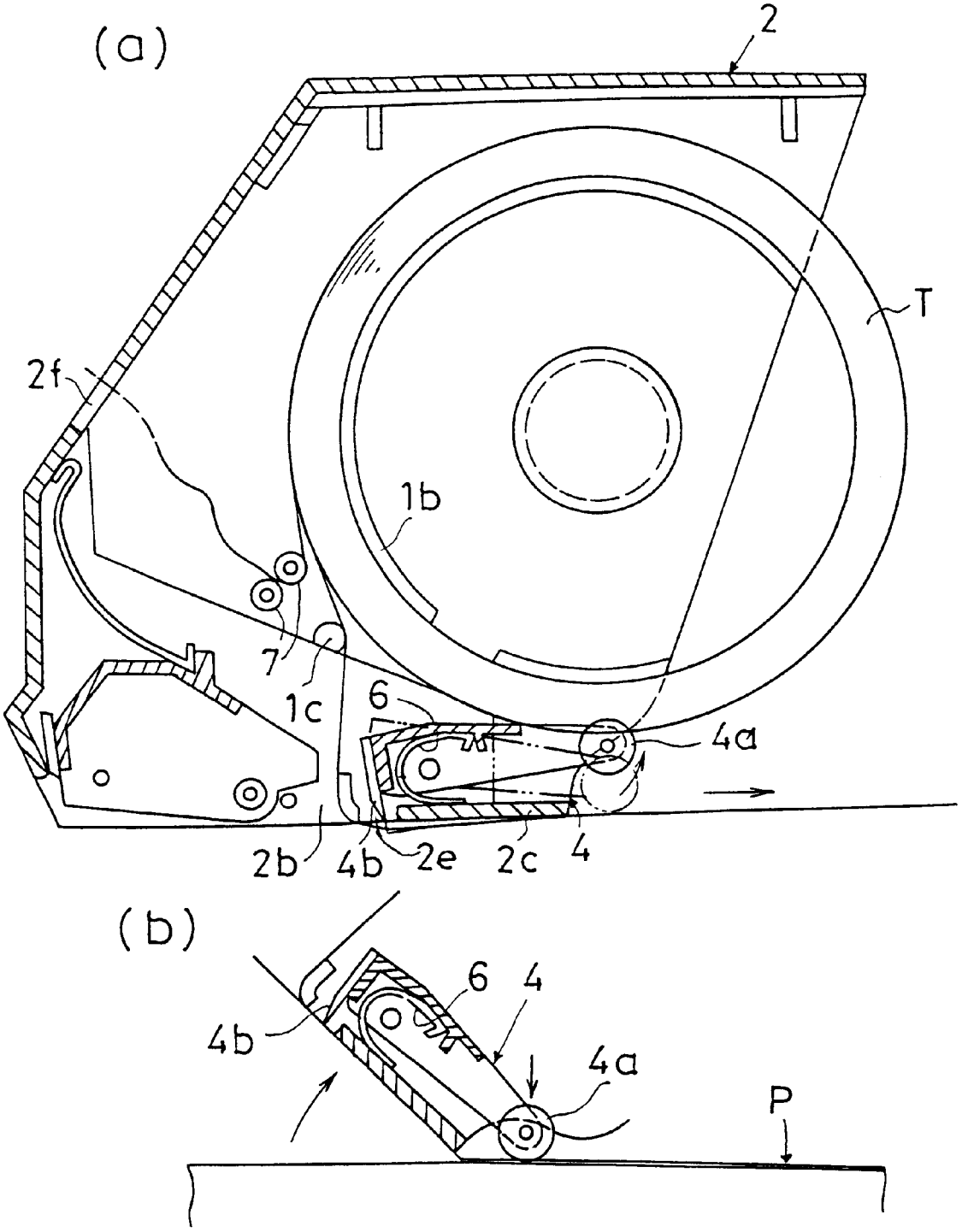
FIGS. 6*a* and 6*b* are a cross-sectional side views of an adhesive-tape dispenser used for a double-side adhesive tape in another operating condition.

FIG. 6 indicates the tape dispenser of this invention designed to a double-side adhesive tape, both sides of which are protected by a peeling tape.

In another operation, the tape roll T having both-side adhesive surfaces, both of which are protected by the peeling tape, is set in the tape roll holder 1 together with its central portion being fit to the arc-shaped protrusions 1*b*. The end portion of the peeling tape P is separated from the unwound tape portion by the user, and then is induced to the separating means 7. Thereafter, the tape end portion pulled out is temporarily contacted to the tape guide member 1*c*.

Then, the tape roll holder 1 is inserted in the dispenser housing 2, in a manner to be guided to the slide guide 2*a*, and the tape end is introduced to the guide roller 3*a* in the tape outlet 2*b*. While the peeling tape separated through the separator 7 is taken out from the side-end opening portion 2*e* and cut off. If necessary, the peeled protect tape may be cut by a cutting means (not shown in the drawings) and fed out from the dispenser housing 2.

As described the above, the user may pick up the tape end portion, and the tape is pulled out and then cut by the cutting blade 3*b* after the suitable length is fed. In this case, the cutting blade is advanced by rotating motion of the member 3 around its pivots, because the guide roller 3*a* is pushed by the pulled tape portion against the bias of the bias means 5.

Similarly, when the user, while gripping the tape dispenser, adheres the pulled tape directly to the surface of the object before the tape is cut, the tape is guided through the tape outlet 2*b* without aid of the guide roller 3*a*. Then, the tape end is introduced from the edge of the tape outlet 2*b* to the tape guide surface 2*c* in a manner to be pulled along the tape guide surface 2*c*.

At the point where the tape is to be cut, the user can push the friction roller 4*a* to the surface of the object through on the opposite side to the adhesive surface of the tape. Accordingly, the direct-action member 4 is turned against the bias of the bias means 6 so as to advance the cutting blade 4*b* to the direct-action member side opening-portion 2*e*, thereby to cut the pulled tape at a position near the tape outlet 2*b*.

Accordingly, this tape dispenser can be applied to various tapes such as non-protected adhesive tape and both-side adhesive tape protected at one side, together with having such a merit that it is safe because the cutting blade is exposed to the outside of the dispenser housing only when in use.

(Second Embodiment)

The tape dispenser of this invention in another embodiment may be modified as follows. The tape dispenser includes a pair of rollers 17 as separating means, and circular stock cage 18. The rollers 17 are formed in the tape roll holder similarly to that mentioned in the first embodiment, and the stock cage 18 is formed in the tape roll holder.

Figure 7:
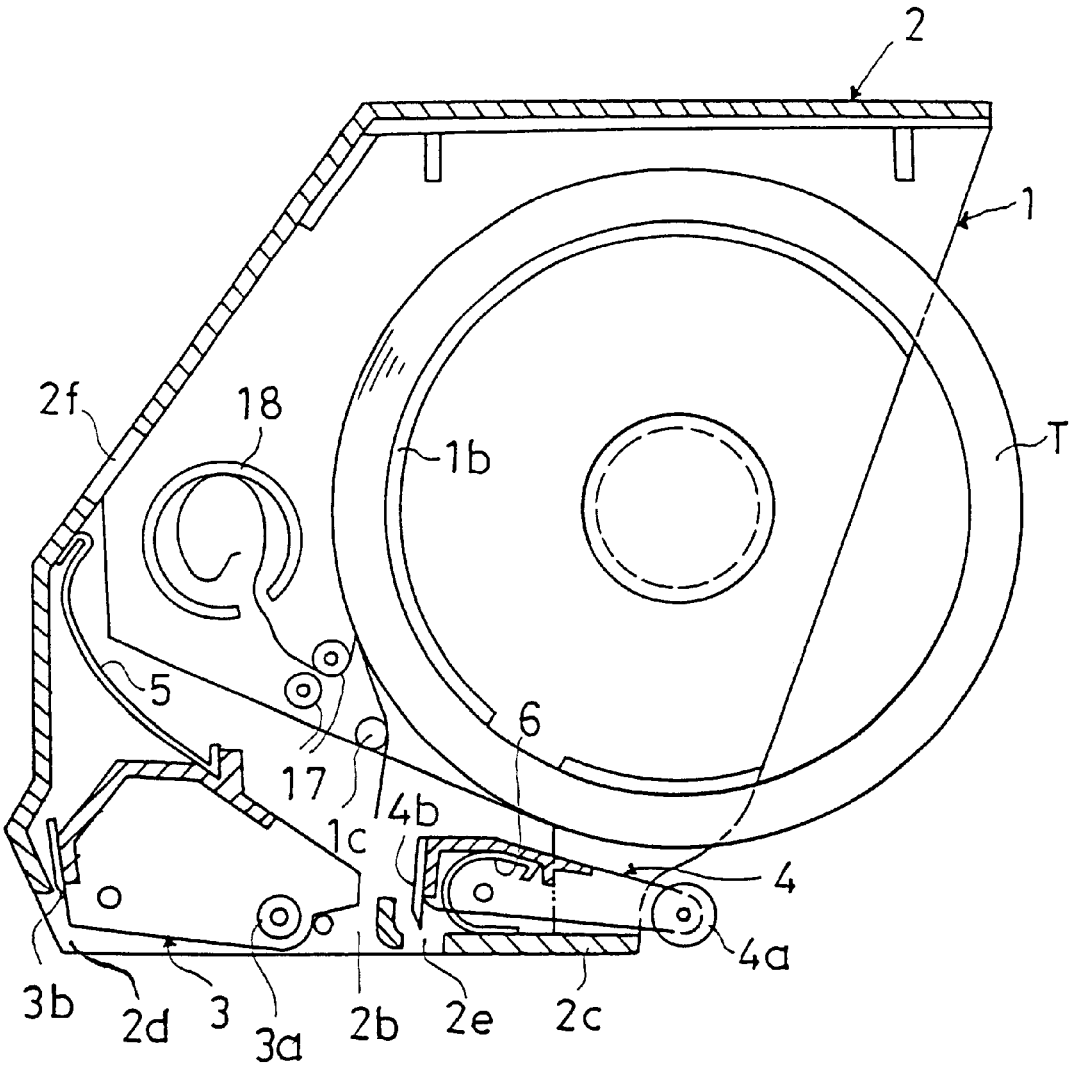
FIG. 7 is a cross-sectional side view of another embodiment in which a separator for a peeling tape is modified to the first embodiment of this invention.

In this embodiment, the other parts of the dispenser are not explained, because each part of the dispenser is same as that described and operated in the first embodiment and the reference number is illustrated in FIG. 7 as the same number.

In operation for peeling the protect tape used for the both-side adhesive tape, the separated protect tape is induced to the circular stock cage 18 through the path between the rollers 17, and is stocked.

After this operation, the pulled portion of the both-side adhesive tape is used in either one of two handling operations(mainly used rotative-action member or direct-action member) in a similar way to that as mentioned in the first embodiment.

In the cases mentioned the above, the cutting blade may be detachable to the action member, and may be adjusted with its advancing length to the cutting position.

While specific embodiments of the invention have been described in details, various modifications therefrom are intended to fall within the scope of the invention as set forth in the claims.

What is claimed is:

1. An adhesive-tape dispenser comprising: a tape roll holder for holding the central portion of the tape roll; a tape guide member formed with the tape roll holder; a dispenser housing for setting the tape roll holder; the dispenser housing including a slide guide for inserting and taking out the tape roll holder; a tape outlet formed in the dispenser housing; and a tape-leading and cutting means.

2. An adhesive-tape dispenser according to claim 1 wherein the tape-leading and cutting means comprises a rotative-action member which is pivoted in the dispenser housing in the tape outlet in a manner to be biased on the opposite side to the tape-leading direction by the bias means, a tape-lead roller co-operated with the tape guide member, and a cutting blade designed to be projected from an opening-portion when the tape is pulled out against the bias of the bias means to the tape-leading direction from the tape roll through the tape guide member and the tape-lead roller.

3. An adhesive-tape dispenser according to claim 1 wherein the tape-leading and cutting means comprises a direct-action member which is pivoted in the dispenser housing near the tape outlet, a friction roller positioned away from the tape outlet via a tape guide surface formed on the dispenser housing, and a cutting blade arranged to the tape guide surface near one edge of the tape to be moved in advance and retreated at an opening portion between the tape outlet and tape guide surface.

4. An adhesive-tape dispenser according to claim 1, including a separator designed to separate a peeling tape from an adhesive tape before it is pulled out.

5. An adhesive-tape dispenser according to claim 2 wherein the tape-leading and cutting means comprises a direct-action member which is pivoted in the dispenser housing near the tape outlet, a friction roller positioned away from the tape outlet via a tape guide surface formed on the dispenser housing, and a cutting blade arranged to the tape guide surface near one edge of the tape to be moved in advance and retreated at an opening portion between the tape outlet and tape guide surface.

6. An adhesive-tape dispenser according to claim 2, including a separator designed to separate a peeling tape from an adhesive tape before it is pulled out.

7. An adhesive-tape dispenser according to claim 3, including a separator designed to separate a peeling tape from an adhesive tape before it is pulled out.

8. An adhesive-tape dispenser according to claim 5, including a separator designed to separate a peeling tape from an adhesive tape before it is pulled out.

* * * * *